US009102431B2

(12) United States Patent
Waid

(10) Patent No.: US 9,102,431 B2
(45) Date of Patent: Aug. 11, 2015

(54) RIGID SUPPORT STRUCTURE FOR RETAINING BAG

(71) Applicant: Everett Waid, Ft. Myers, FL (US)

(72) Inventor: Everett Waid, Ft. Myers, FL (US)

( * ) Notice: Subject to any disclaimer, the term of this patent is extended or adjusted under 35 U.S.C. 154(b) by 0 days.

(21) Appl. No.: 13/835,351

(22) Filed: Mar. 15, 2013

(65) Prior Publication Data

US 2014/0117012 A1 May 1, 2014

Related U.S. Application Data

(60) Provisional application No. 61/718,512, filed on Oct. 26, 2012.

(51) Int. Cl.

| | |
|---|---|
| ***B65B 67/04*** | (2006.01) |
| ***B21B 29/00*** | (2006.01) |
| ***E02D 29/02*** | (2006.01) |
| ***B31B 29/00*** | (2006.01) |
| ***E02B 3/10*** | (2006.01) |

(52) U.S. Cl.

CPC ..... *B65B 67/04* (2013.01); *B31B 29/00* (2013.01); *E02B 3/108* (2013.01); *E02D 29/0291* (2013.01)

(58) Field of Classification Search

CPC ..... E02B 3/108; E02D 29/0291
USPC ..... 141/1, 313, 314; 220/1.5, 484, 510, 220/529, 9.4; 383/32, 33; 405/31, 32, 107, 405/111, 114; 493/210; 248/95
See application file for complete search history.

(56) References Cited

U.S. PATENT DOCUMENTS

| | | | |
|---|---|---|---|
| 6,390,154 | B1 | 5/2002 | Hall |
| 2010/0008726 | A1 | 1/2010 | Heselden |

FOREIGN PATENT DOCUMENTS

| | | |
|---|---|---|
| DE | 19938294 | 11/2000 |
| DE | 202009009274 | 11/2009 |

OTHER PUBLICATIONS

International Search Report and Written Opinion for PCT/US2013/032208.

*Primary Examiner* — Tara M. Pinnock
(74) *Attorney, Agent, or Firm* — Stockwell & Smedley, PSC

(57) ABSTRACT

The present invention provides a support structure article having a frame with a top side, bottom side, back side and front side. The front side may include both a straight front side and slanted front side between the top side and the straight front side. The top side and bottom side of the frame may be parallel, and the back side and straight front side of the frame may be parallel. The top side and bottom side of the frame may each be perpendicular to the back side and straight front side of the frame. The article may also have a first set and a second set of crossing members inside the frame that intersect. A bag is also provided having walls that correspond in shape to the sides of the frame. Methods of making and using the bags and/or support structures of the present invention are also provided.

15 Claims, 5 Drawing Sheets

RIGID SUPPORT STRUCTURE FOR RETAINING BAG

CROSS-REFERENCE TO RELATED APPLICATIONS

This application claims priority benefit to U.S. Provisional Application No. 61/718,512, entitled "Rigid Support Structure for Retaining Bag," having a filing date of Oct. 26, 2012, the entire contents and disclosure of which are incorporated herein by reference.

BACKGROUND

1. Field of the Invention

The present invention relates to a support structure or partition for use inside a bag for retaining flood waters.

2. Related Art

Flooding is a major concern for cities, towns, businesses and property owners near bodies of water or in low lying areas. Rainfall and/or storm surge from storms, hurricanes and other meteorological events can cause major damage to property structures. Likewise, rising rivers downstream from these weather events as well as the breach or breaking of man-made structures, such as dams and levees, can result in significant and widespread flooding to nearby areas. Thus, retaining walls or structures may be erected to contain and divert the flood waters and protect the property structures that might otherwise be affected. Sandbags and other methods have been used to construct retaining walls or barriers. However, there is often little notice of an approaching or imminent flooding threat, and many of the existing methods for building retaining structures are labor intensive and slow.

There remains a need in the art for new and improved ways to quickly erect a retaining wall, bag or structure that is effective at retaining flood waters.

SUMMARY

According to a first broad aspect of the present invention, a support structure is provided comprising: a frame having a top side, a bottom side, a back side and a slanted front side; a first set of crossing members; and a second set of crossing members, wherein the first and second sets of crossing members span from one side of the frame to another side of the frame, wherein at least one crossing member of the first set of crossing members intersects at least one crossing member of the second set of crossing members.

According to a second broad aspect of the present invention, a bag is provided comprising: at least one flexible sheet of material; and at least one support structure, wherein the at least one support structure comprises a frame having a top side, a bottom side, a back side and a slanted front side; a first set of crossing members; and a second set of crossing members, wherein the first and second sets of crossing members span from one side of the frame to another side of the frame, wherein at least one crossing member of the first set of crossing members intersects at least one crossing member of the second set of crossing members, and wherein the at least one flexible sheet of material is attached to the frame of the at least one support structure.

According to a third broad aspect of the present invention, a method of erecting a retaining bag is provided comprising: extending the bag in a longitudinal direction from a collapsed state; and filling the bag with a filling material through a top opening of the bag, wherein the bag comprises at least one flexible sheet of material; and at least one support structure, the at least one support structure comprising a frame having a top side, a bottom side, a back side and a slanted front side; a first set of crossing members; and a second set of crossing members, wherein the first and second sets of crossing members span from one side of the frame to another side of the frame, wherein at least one crossing member of the first set of crossing members intersects at least one crossing member of the second set of crossing members, and wherein the at least one flexible sheet of material is configured to form the walls of the bag around the outer periphery of the frame of the at least one support structure.

According to a fourth broad aspect of the present invention, a method of making a retaining bag comprising: wrapping a flexible sheet of material around an outer periphery of at least one support structure having a planar shape, the at least one support structure disposed in an upright position such that the plane of the at least one support structure is approximately perpendicular to the flexible sheet of material; and attaching the at least one support structure to the flexible sheet of material, wherein the at least one support structure comprises a frame having a top side, a bottom side, a back side and a slanted front side; a first set of crossing members; and a second set of crossing members, wherein the bottom side, the back side and the slanted front side correspond respectively to the bottom wall, the back wall and the slanted front wall of the bag, and wherein the first and second sets of crossing members span from one side of the frame to another side of the frame, wherein at least one crossing member of the first set of crossing members intersects at least one crossing member of the second set of crossing members.

DETAILED DESCRIPTION

Figure 1:
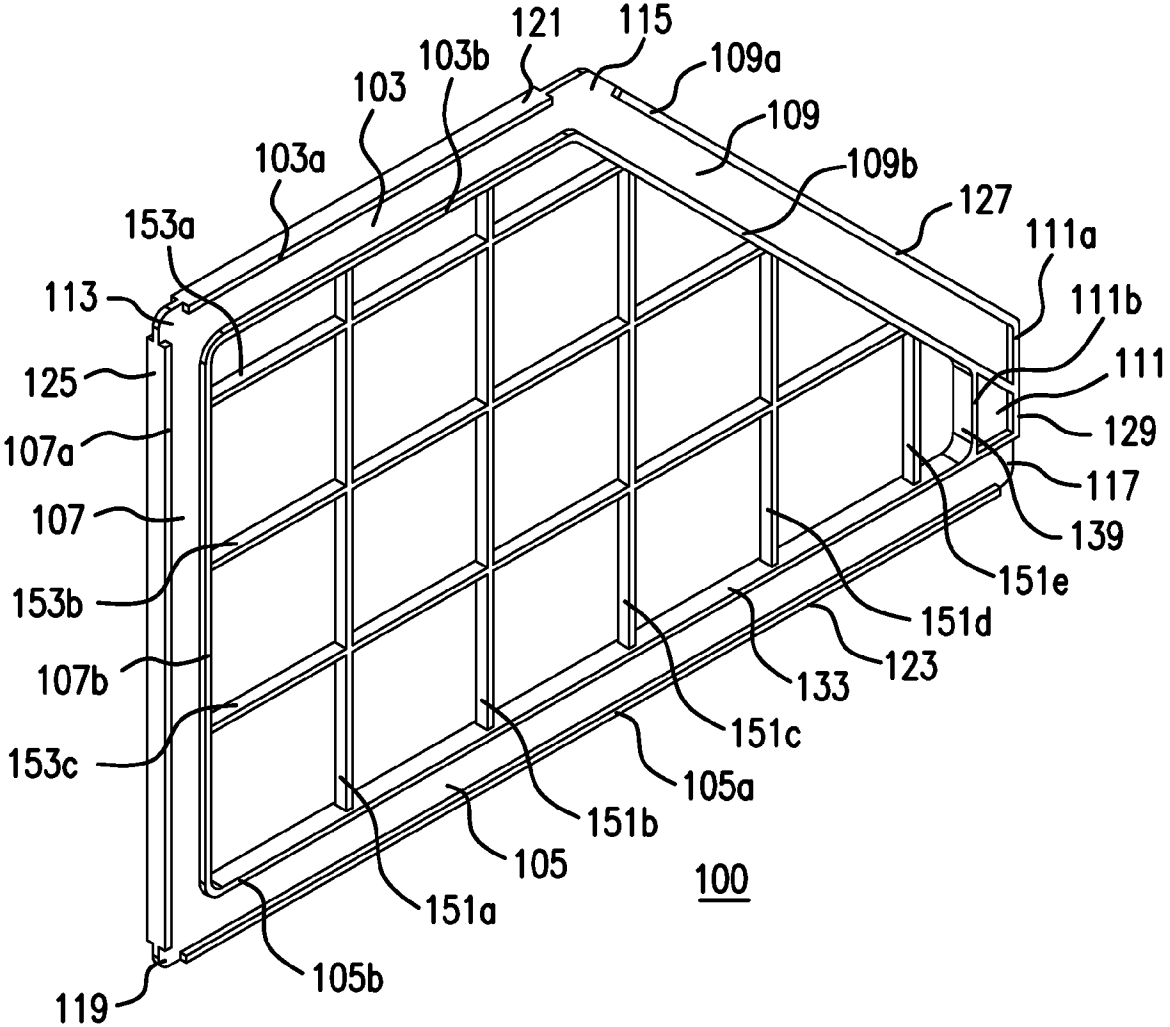
FIG. 1 is a perspective view of a support structure article of the present invention for use as part of a retaining bag.

The present invention relates to a support structure for use inside a bag that is filled with a filling material to build a retaining wall or structure for holding back water to thereby protect buildings, facilities, homes, etc., from floods. Such bag(s) that may be used with a support structure of the present invention may comprise a back wall, a front wall and a bottom wall and may further comprise a plurality of cells aligned from side to side. The bag may comprise a plurality of side walls with each set of adjacent cells of the bag separated by a respective side wall. The side walls may form the ends of the bag to contain the contents of the bag and/or divide adjacent cells of the bag. Such bag(s) may further include a top wall that may be formed as a flap to open and close a top opening of the bag. Together these walls may enclose an interior of the bag to contain a filling material inside the bag, the filling material being used to give weight to the bag so that it can withstand the forces of the floodwaters and remain in place. The filling material may include any suitable material, such as stones, crushed rock, concrete, cement, sand, etc., and/or liquids, such as water, or combinations thereof. The crushed rock may either have an average or nominal particle size of 1 inch or more or 1 inch or less.

Such a bag used with a support structure of the present invention may have a common and continuous top, bottom, back and/or front walls and/or may also comprise a plurality of cells divided by side walls and/or support structures. In general, the back wall of the bag may be approximately perpendicular to the top and/or bottom wall(s) of the bag when the bag is filled, and the top and bottom walls of the bag may be approximately parallel to one another when the top wall (if present) is closed and the bag is filled. For purposes of the present invention, the term "approximately" includes "nearly," "about," "almost" and "exactly." However, the front wall may be slanted at a non-perpendicular angle relative to the top, bottom and/or back wall(s) of the bag. For additional description of a bag(s) that may be used with the support structure of the present invention, see, e.g., U.S. patent application Ser. No. 12/590,184, now U.S. Pat. No. 8,235,631, and U.S. patent application Ser. No. 13/442,152, the entire contents and disclosures of which are incorporated herein by reference.

The support structure of the present invention may be inserted into the interior of the bag in an upright orientation to keep the bag "standing up" and extended in a vertical direction until enough filling material has been poured into the bag for the filling material itself to support the bag. Indeed, the walls of the bag may be made of any suitable flexible material in the form of a sheet that can collapse and fold when it is empty and/or conform to the shape of the filling material when the bag is filled. Although the walls of the bag are flexible and bendable, the material should also be rugged and resilient enough to contain the filling material and withstand the forces of the floodwaters. Thus, the walls of the bag may be made of any combination of woven and nonwoven materials, films, fabrics, plastic sheets, wire mesh, etc., or any combinations thereof. Thus, the support structure of the present invention may be inserted into, and/or form a functionally integral part of, the bag, which may help to keep the bag supported until and while a filling material is poured into the bag. This may be due at least in part to the walls of the bag being supported around an outer periphery of the support structure (i.e., around and on the outer surfaces of the sides of the support structure frame). Multiple support structures may be inserted into, and/or form part of, the bag and aligned substantially or approximately in parallel with each other such that the bag with the support structures may be collapsed in its lengthwise or longitudinal dimension. Prior to filling the bag with a filling material, a bag with a plurality of the support structures placed therein may be extended or pulled out like an accordion from a collapsed state to place the bag into a desired position. This extension and placement may be done quickly since the support structures help to maintain the bag in an upright position. Once filled with the filling material, the support structure(s) inside the bag may continue to function in providing additional strength and resiliency to the bag.

A support structure of the present invention may have a plurality of crossing members with spaces or openings between them to allow a filling material to flow through it and spread out between adjacent compartments or cells of the bag separated by and on either side of the support structure. These crossing members may have any of a variety of different cross-sectional shapes, such as rectangular, square, diamond, circular, oval, etc., and a variety of suitable sizes or thicknesses. According to other embodiments, however, one or more of the support structure(s) inside the bag may be solid without openings or spaces between the crossing members that may function as a partition or barrier to contain and separate the contents or filling material of the bag on either side, such as between adjacent cells. Alternatively, a support structure having crossing member(s) with spaces or openings between them may still form a solid barrier in conjunction with a side wall of the bag itself, such as between adjacent cells of the bag. Such a partitioning or barrier function may allow the support structure to be used as one or both of the two ends of the bag to contain the contents or filling material inside the bag. Such a partitioning or barrier function of a support structure of the present invention may also help to secure a retaining wall or bag when it is breached or damaged by maintaining separate compartments, especially when a liquid filling material, such as water, is used.

A support structure of the present invention may comprise an outer frame that surrounds an inner space with crossing members spanning across the inner space from one side to another side of the frame. The support structure may have a mostly two-dimensional or planar shape with varying thicknesses in a third dimension depending on its exact design and construction. However, these thickness dimension(s) will be much less than the two planar dimensions. The crossing members within the inner space may include a first set or subset of crossing members that intersect a second set or subset of crossing members at an approximately perpendicular or other angle. The crossing members may provide strength and rigidity to the support structure. In general, spaces or openings will be present between the crossing members, such that the filling material in a bag may flow through the support structure to contact and exchange with the contents or filling material on the other side. However, according to other embodiments, the network of crossing members of a support structure may instead form part of a barrier or partition that physically separates the contents of the bag present on either side, such as by supporting a thin sheet or web of the support structure that fills the area between the crossing members. Alternatively, the network of crossing members may help support a thin sheet of material, such as a fabric portion or side wall of the bag, to separate and form a barrier between the two sides, which may be two adjacent cells of a bag.

The support structure of the present invention may be made as a single integral unit and may be made of any suitably rigid material including plastic, wood and/or metal (including wire mesh) and any combinations thereof. The support structure may be made by any suitable process(es), such as by injection molding, etc. The support structure of the present invention may be a single piece that may be made by one process, or it may comprise two or more units or pieces that may be securely coupled together (e.g., snapped or welded together, etc.). According to these embodiments, a plurality of fasteners (e.g., corresponding snap locks, etc.) may be used to hold the two or more pieces together. For example, the support structure may comprise a first bisected portion and a second bisected portion, each bisected portion or half having generally planar dimensions that approximate the two-dimensional shape of the assembled article (i.e., when the two portions or halves are coupled or fastened together). The fabric or material of a side wall (such as a side wall dividing two adjacent cells) may be sandwiched between the two bisected portions when fastened together.

Figure 2:
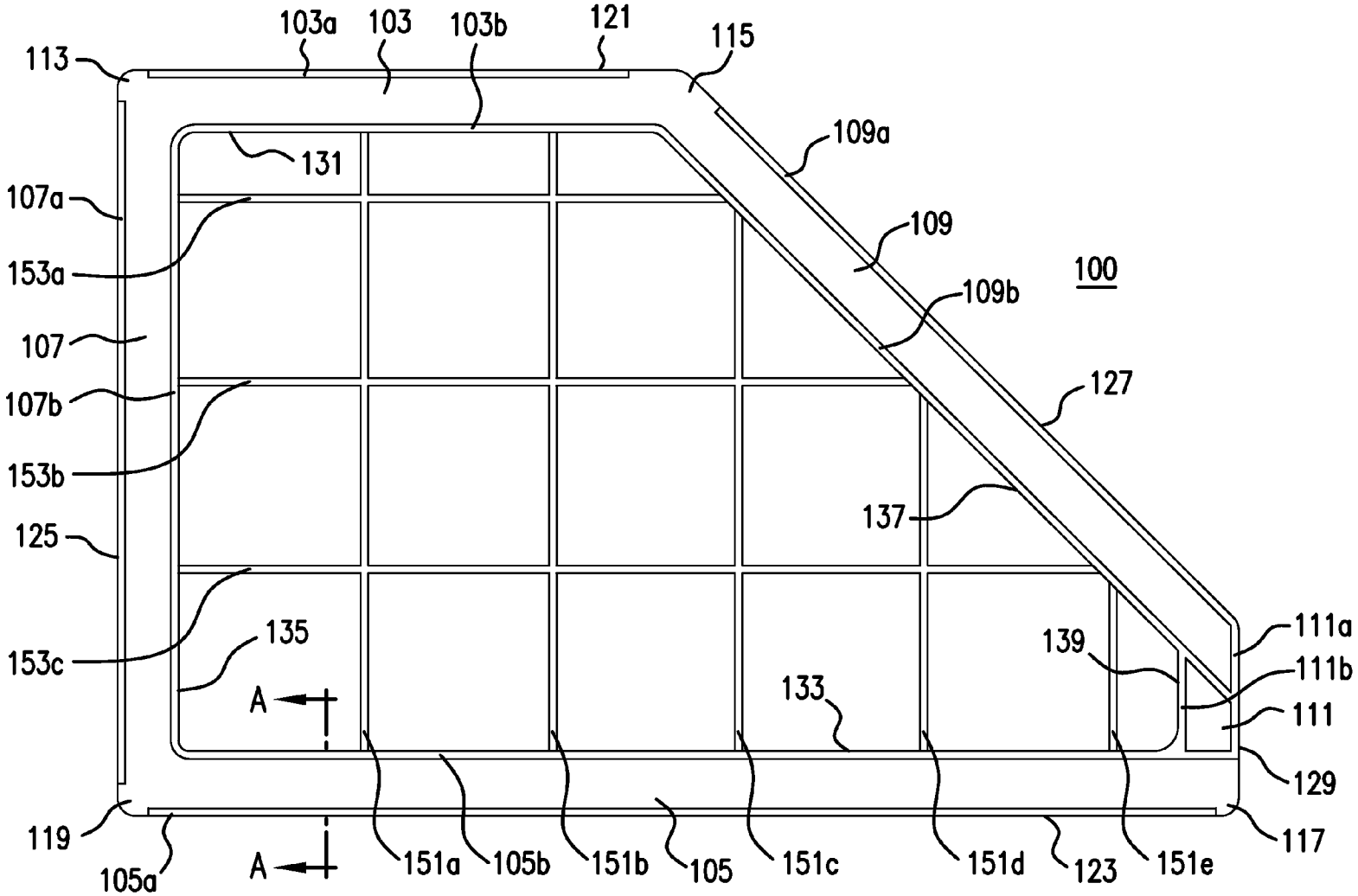
FIG. 2 is a side view of the support structure article shown in FIG. 1.

FIGS. 1 and 2 provide two views of an embodiment of a support structure 100 of the present invention. The support structure comprises a frame having a top side 103, a bottom side 105, a back side 107, a slanted front side 109 and a straight front side 111. The back side 107 of the frame may be approximately perpendicular to both the bottom side 105 and the top side 103 of the frame, and the top and bottom sides 103, 105 may be approximately parallel to each other. The straight front side 111 may also be approximately parallel to the back side 107. Each of the sides may have a narrower middle area or portion between two wider flanges or edges. The wider flanges or edges may function to provide additional strength (much like an I-beam) and also to possibly provide a corresponding structure for fastening a wall of the bag to the support structure. The top side 103 of the frame may thus include an outer flange 103*a* and an inner flange 103*b*, the bottom side 105 may include an outer flange 105*a* and an inner flange 105*b*, the back side 107 may include an outer flange 107*a* and an inner flange 107*b*, the slanted front side 109 may include an outer flange 109*a* and an inner flange 109*b*, and/or the straight front side 111 may include an outer flange 111*a* and an inner flange 111*b*. Each of the outer flanges has a respective outer surface 121, 123, 125, 127, 129, and each of the inner flanges has a respective inner surface 131, 133, 135, 137, 139. Each pair of adjacent outer flanges may be separated by a respective open corner 113, 115, 117, 119 such that the adjacent flanges are not continuous. Such openings may be used to facilitate or enable fastening of the fabric or material of the bag to the retaining structure with an additional fastener as further explained below. For purposes of the present invention, the terms "outer surface" and "inner surface" refer to the outer and inner surfaces of the frame regardless of whether flanges are present.

The sizes and dimensions of the support structure may vary and may correspond to (i.e., be about the same as) the inner dimensions of the bag that it would be used to support. Accordingly, the back side of the frame of the support structure may for example be in a range from about 1¼ feet to about 12 feet long, such as from about 2 feet to about 6 feet, or about 2, 4 or 6 feet long, and/or the bottom side of the frame of the support structure may be in a range from about 1½ feet to about 14 feet long, such as from about 2 feet to about 8 feet, or about 2, 3, 5, 6, 7 or 8 feet long. The thickness of the support structure may vary between ⅛ inch and a few inches, such as from about ¼ to about ¾ inch. For example, the flanges of a respective side may be about ¾ to about 2 inches thick, whereas the portions between the flanges may be about ¼ to about 1 inch thick. The top side 103 of the frame of the support structure may vary depending on the length, position and angle of the slanted front side 109, but the top side 103 of the frame may for example be about 1 foot to about 12 feet, such as about 3 or 4 feet. The angle between the slanted front side 109 and the straight front side 111 may vary from about 110° to about 170° (i.e., the slanted front side may be angled from about 10° to about 70° off of a vertical line), or the angle between the slanted front side 109 and the straight front side 111 may vary from about 120° to about 160°, or it may be about 135 (i.e., slanted front side may be angled about 45° off of a vertical line). The length of the straight front side 111 may vary and may for example be between about 6 inches and about 3 feet, such as about one foot. The length of the slanted front side 109 will depend accordingly. Other dimensions are also possible.

Adjacent crossing members of each of a first set and a second set of crossing members may be spaced apart by a constant distance along their length (if parallel) or by a changing distance (if non-parallel). Such a spaced apart distance between adjacent crossing members of each set may vary for example between about 2 inches and about 24 inches, or from about 6 to about 18 inches, such as about 12 inches. If both an inner and outer flange are present on a side of the frame, the spacing between the inner and outer flanges of each side of the frame may be the same or different among the different sides of the frame and such spacing may vary for example from about ½ inch to about 5 inches, such as about 2 inches.

Figure 3:
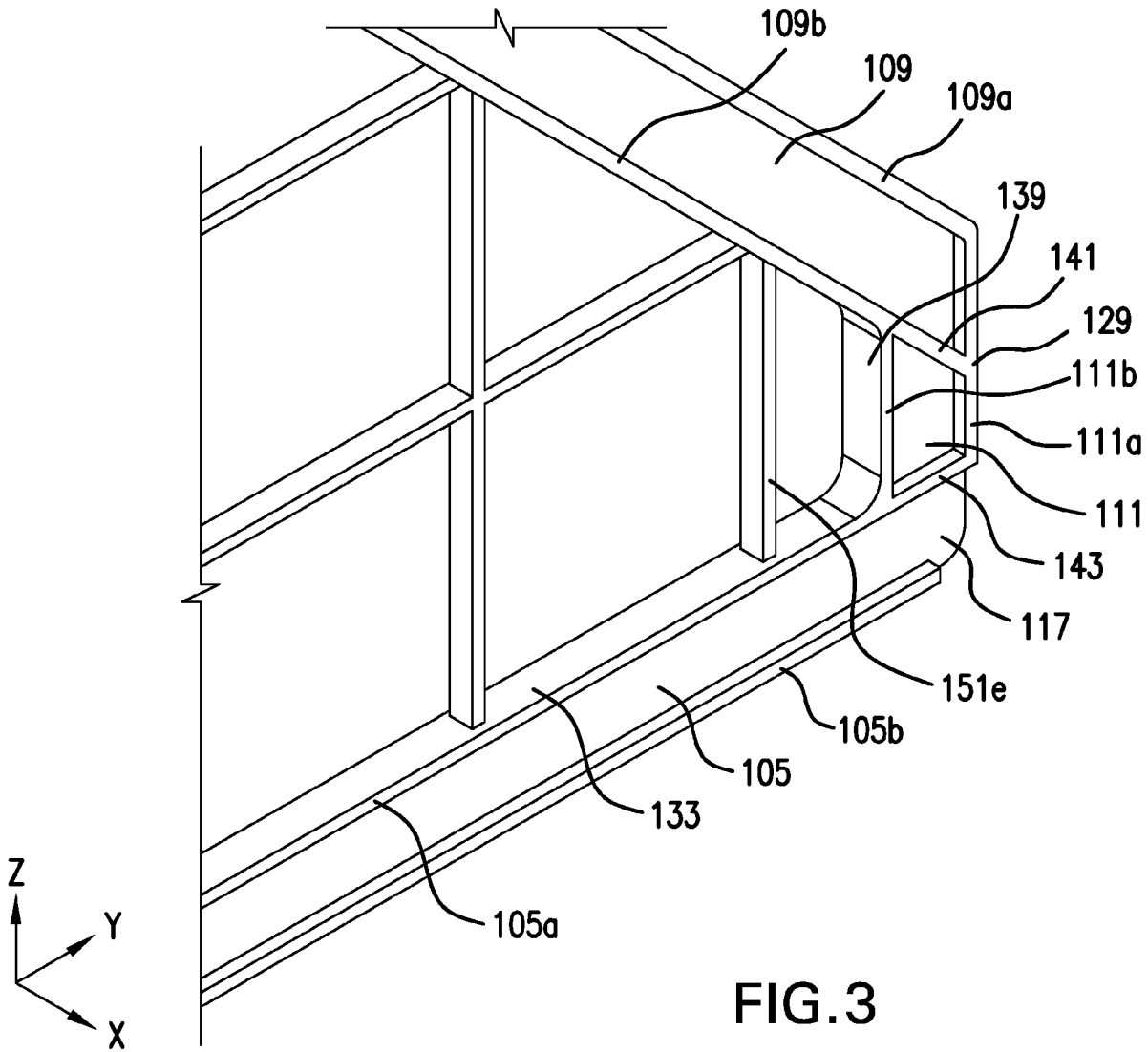
FIG. 3 is a perspective view of a front-bottom corner of the support structure article shown in FIG. 1.

The bottom side and/or the slanted front side of the support structure frame may be longer than the back side of the support structure frame. According to some embodiments as shown in FIGS. 1, 2 and 3, the front of the support structure frame may include both a slanted front side 109 and a straight front side 111 such that the slanted front side 109 and bottom side 105 do not extend to a point where the two sides might otherwise meet. Instead of meeting at a point, the straight front side 111, which may be nearly, approximately or exactly parallel to the back side 107 of the frame, joins and connects the bottom and slanted front sides 105, 109. Accordingly, the bottom side and slanted front side would be shorter with these embodiments than if they extended and met at a point. It is believed that by providing a straight front side, the support structure may be stronger and less susceptible to breaking or cracking. Straight front side 111 of support structure 100 is shown in a close up view in FIG. 3 to show additional optional flanges 141, 143 extending from inner flange 109*b* of slanted front side 109 and inner flange 105*b* of bottom side 105, respectively, to outer flange 111*a* of straight front side 111. However, these optional flanges 141, 143 may be absent. As another alternative, the bottom and slanted front sides could extend and meet at a point without a straight front side.

In addition to the frame, there may also be a plurality of crossing members within the space between the sides of the frame spanning from one side of the frame to another (i.e., from one inner surface of the frame to another) to provide structural support to the frame and the article or support structure as a whole. According to some embodiments, such a plurality of crossing members may comprise multiple sets or subsets of crossing members, such as a first set or subset of crossing members and a second set or subset of crossing members. The first set of crossing members may not intersect each other but may intersect the second set of crossing members. Likewise, the second set of crossing members may not intersect each other but may intersect the first set of crossing members. The first and second set of crossing members may intersect at a perpendicular or other angle. The crossing members may also be oriented at non-perpendicular angle(s) relative to the frame, and the crossing members of each of the first set or the second set of crossing members may not be parallel to each other.

FIGS. 1, 2 and 3 provide an embodiment of the present invention showing a first set of crossing members 151*a*, 151*b*, 151*c*, 151*d*, 151*e* oriented vertically (and parallel to the back side of frame) and a second set of crossing members 153*a*, 153*b*, 153*c* oriented horizontally (and parallel to the top and bottom sides of frame). Accordingly, each of the first set of vertical crossing members is perpendicular to each of the second set of horizontal crossing members. The embodiment in these figures shows open spaces between the crossing members of the support structure, but as mentioned above, a thin web or sheet of material may span and fill the space between the crossing members to create a barrier to prevent or reduce the flow of filling material through the support structure. This may be useful when a liquid or fine filling material is used to fill the bag to provide resiliency against puncture or breach of the bag.

Once the support structure of the present invention is inserted into a desired position within the bag, it may be connected, attached or secured to the bag in any of a variety of suitable ways. As a few examples, the outer surface(s) of the support structure may be adhered or glued to the bag, the frame of the support structure may be welded to the bag, the bag may be clamped to the frame of the support structure, a fastener may penetrate the bag and engage the support structure, the support structure may be trapped in the bag, such as by mounding an initial amount of filling material around the base or bottom of the support structure or by placing the support structure against a side wall of the bag, etc., before filling up the bag with the filing material.

FIG. 4 provides a few example embodiments for attaching, fastening, etc., the bag to the support structure, showing attachment of the fabric of the bag, for example, to the bottom side of the support structure in cross section at a position indicated by line A-A in FIG. 2. A similar form of attachment of the bag fabric to other side(s) of the frame may be used. Indeed, the bag fabric may be attached to one or more of the top side 103, back side 107, bottom side 105, slanted front side 109, and/or straight front side 111 of the support structure. However, the bag fabric may not be attached to the bottom side 105 of the frame.

Figure 4B:
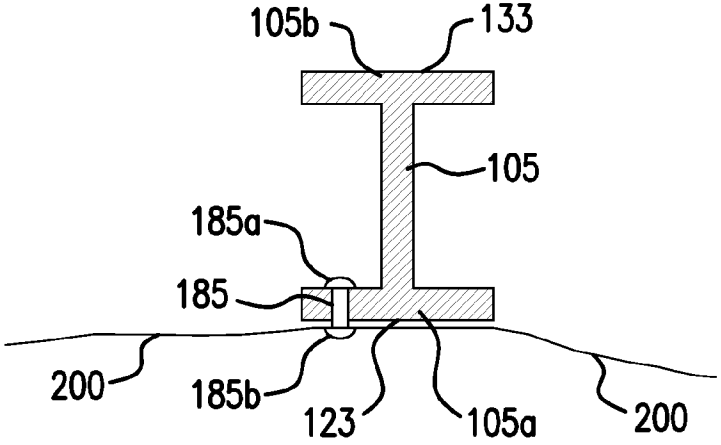
FIG. 4B is a cross sectional view of the frame of a support structure attached to a wall of the bag with a fastener.
Figure 4A:
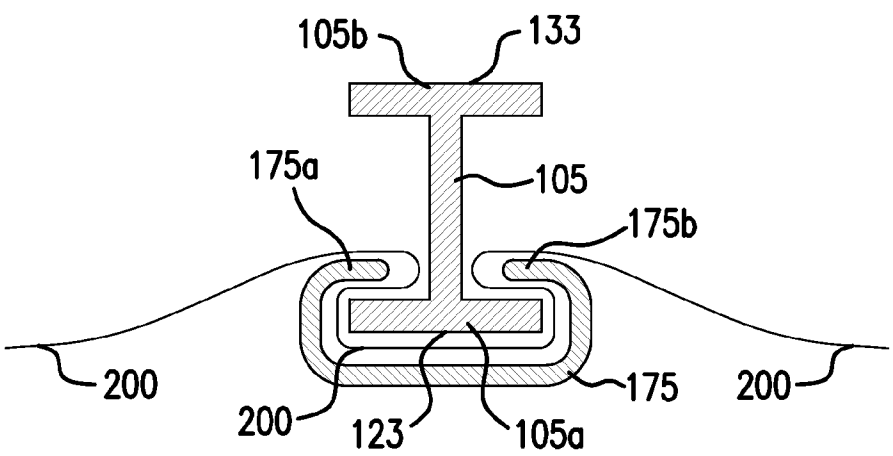
FIG. 4A is a cross sectional view of the frame of a support structure attached to a wall of the bag with a clip.
Figure 4C:
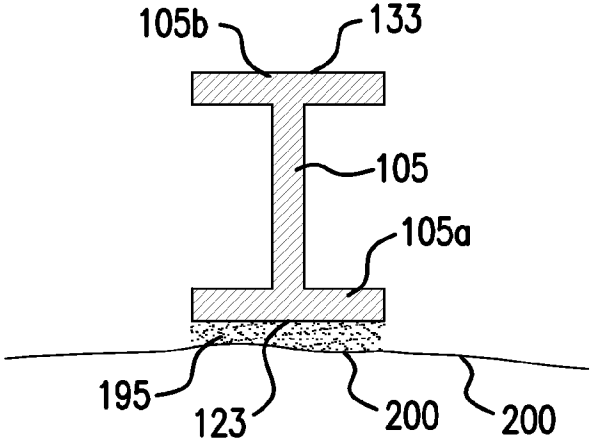
FIG. 4C is a cross sectional view of the frame of a support structure attached to a wall of the bag with an adhesive.

FIG. 4A shows an embodiment in which an elongated clamp 175 with two wrapping portions 175*a*, 175*b* that envelop outer flange 105*a* to hold fabric 200 of bag to the support structure. Clamp 175 may be snapped onto frame or may be slid over fabric and frame from a corner. Open corners 113, 115 117, 119 allow a sliding clamp to engage the frame by one end of the elongated clamp 175 entering one of the open corners and then sliding down the length of a side of the frame adjacent to the open corner and wrapping around the corresponding outer flange. As an alternative, smaller individual clamps may instead be used. FIG. 4B provides another embodiment for attaching or fastening the fabric 200 of the bag to the side 105 of the frame of the support structure. One or more fastener(s) 185 may be used that penetrate the fabric 200 and engage a portion of the outer flange 105*a* of the side 105 of the frame. Such a fastener(s) may have a shaft portion and two wider portions 185*a*, 185*b* that hold the bag to the frame by engaging an inner surface of the outer flange 105*a* and the outer surface of the bag, respectively. This will hold the bag 200 against the outer surface 123 of the frame. A wide variety of known fastener(s) may be used to fulfill this purpose including any suitable rivet, screw, bolt, snap-lock, staples, etc. FIG. 4C provides yet another example for attaching the bag to the frame. An adhesive or glue 195 may be used to secure the bag to the frame between the inner surface of the bag 200 and the outer surface 123 of the frame. However, these examples in FIG. 4 are merely illustrative, and any other suitable form of attachment, etc., may also be used.

However, these attachment examples are not exhaustive, and any suitable attachment method may be used. As an additional example, various ties, such as ties, wires or straps made of plastic, metal, string, yarn, etc., may be used to secure the bag to the support structure, such as by wrapping around the frame of the support structure. As another example, open rings, such as hog rings, may be clamped to secure the bag to the support structure, such as through a hole in the frame of the support structure. Such open rings may be useful if the bag itself is made of a wire or wire mesh. As yet another example, a plastic or metal banding may be used that extends around the top, back, bottom and front walls of the bag to make a vertical loop at a position where the support structure is located underneath the bag. Such banding material may be tightened and/or attached to the support structure by any suitable method. To accommodate the flap or top wall, a hole that may be reinforced, such as with a grommet, may be used to allow the banding to poke through and not interfere with the flap or top opening.

In contrast to the embodiment shown in FIGS. 1, 2 and 3, the outer frame of the support structure may have a variety of cross sections, such as rectangular, square, etc. In addition, one or both of the inner and/or outer flanges may be absent on one or more sides of the frame especially if not needed for the fastening. Indeed, one or more sides of the frame may have a "T-beam" shape with one of the inner or outer flanges absent on a respective side(s) of the frame. However, the I-beam shape may be preferred as a way to increase strength and rigidity while minimizing the amount of material used. Moreover, even if the "I-beam" design is used for the frame of the support structure, one or more of the open corners may be absent (i.e., the respective outer flanges may be continuous without a gap or opening).

According to other embodiments, a bag comprising one or more support structures disposed therein are also provided. Such a bag of the present invention may comprise a fabric that is wrapped around an outer periphery (i.e., the outer surfaces of the sides of the frame) of the one or more support structures, such that the fabric forms a slanted front wall, a straight front wall, a bottom wall, and a back wall corresponding to the sides of the support structure. Each of these "walls" of the bag may be formed by a continuous piece of fabric. In addition, one or more side walls and/or a top wall of a fabric may also form part of the bag. A bag comprising one or more side walls may have a plurality of cells defined by the side walls (i.e., each of the side walls may separate adjacent cells of the bag). The top wall may be disposed as a flap to move from an open to a closed position, the open position allowing a filling material to be put into the bag. The one or more side walls may be attached to the slanted and straight front, back and/or bottom walls by any suitably method including stitching, sewing, gluing, bonding, fastening, welding, etc. According to some embodiments, the attachment between the side wall(s) and the slanted and straight front, back and/or bottom walls may be continuous, such as to form a seal, or it may have gaps or openings in one or more places.

According to these embodiments, one or more planar support structures as described herein may be inserted, placed, disposed, etc., inside the bag in an arrangement that is nearly, approximately or exactly perpendicular to the slanted front, straight front, bottom and back walls of the bag that correspond to the respective sides of the support structure. If two or more support structures are inserted, placed, disposed, etc., inside the bag, then they may be arranged nearly, approximately or exactly parallel in relation to each other. According to some embodiments, a single sheet of fabric may be folded and wrapped around the one or more support structures to form the bag with the shape of the support structures determining the shape of the bag including the walls of the bag as discussed herein. For example, the single sheet of fabric of the bag may begin at or near the junction of the top side and the slanted front side of the support structure and extend around the front sides, bottom side and back side of the support structure(s) and held in place by attachment, etc., to the frame of the support structure(s) by any suitable method as described herein. The single sheet of fabric may also extend beyond the top corner of the back side of the support structure to form a foldable or movable flap that may be closed to form a top wall of the bag (i.e., by folding the distal edge of the flap down to meet the bag near the corner where the top side and slanted front side of the support structure meet). In other words, the flap may be folded down to form the top wall of the bag and close the top opening of the bag. Alternatively, the flap may be absent or kept open (i.e., folded back) during use of the bag. Alternatively, the bag may comprise more than one sheet or piece of fabric that may be connected, attached, etc., together, especially for any side wall(s).

The bag of the present invention has an elongated shape with a longitudinal axis, the longitudinal or lengthwise dimension being approximately parallel to the front, bottom and back walls of the bag. A plurality of support structures may be placed inside the bag at spaced-apart distances with the plane of each of the support structures being approximately perpendicular to the longitudinal axis of the bag. The spaced-apart distances between adjacent support structures along the length of the bag may be the constant or variable and may be in a range from about 1 feet to about 8 feet, such as about 2, 3 or 4 feet. To contain a filling material that may be deposited into the bag, the two ends of the bag (in the longitudinal axis) may be enclosed by either a fabric of forming the end of the bag (e.g., by folding the fabric material of the bag or by attaching a separate end piece of fabric to the bag), or by use of a support structure partition that forms a solid barrier without openings or spaces to contain the contents or filling material of the bag.

Figure 5:
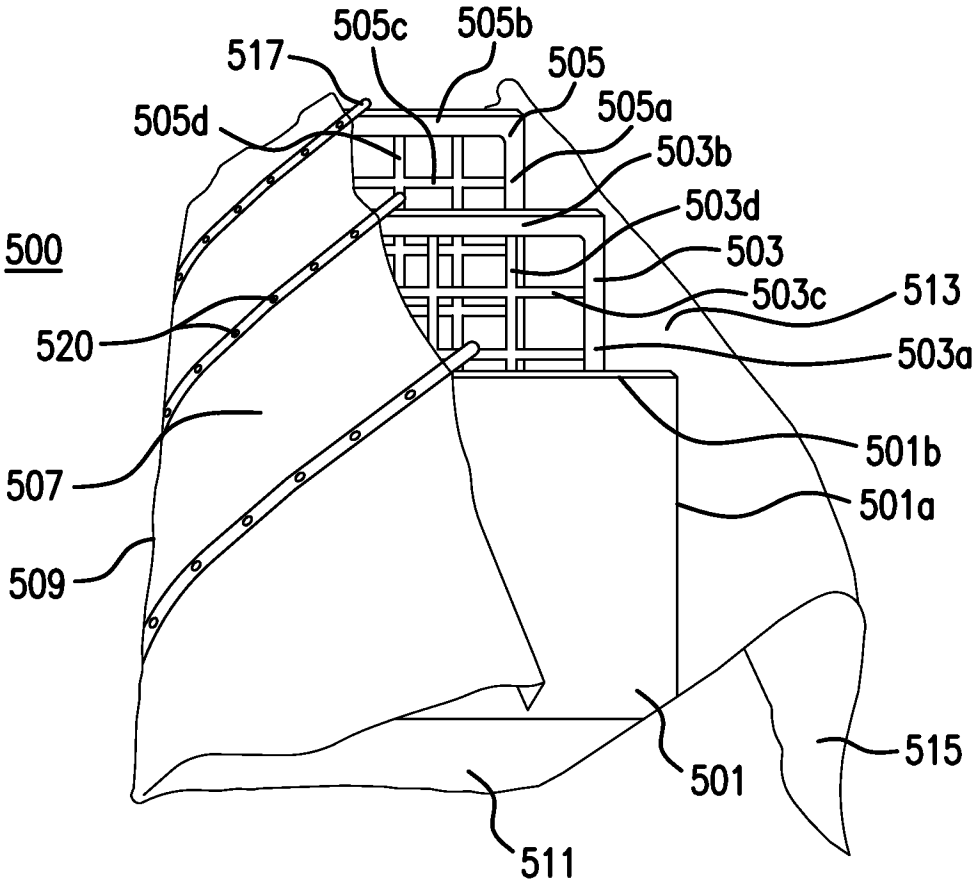
FIG. 5 is a perspective view of the bag of the present invention with a plurality of support structures inserted therein.

FIG. 5 shows a bag 500 according to an embodiment of the present invention. The bag may comprise a single sheet of fabric wrapped around the perimeter of a plurality of support structures 501, 503, 505. The bag is shown truncated at the far end for purposes of presentation in the figure but may actually be much longer with additional spaced-apart support structures. Due to the shape of the support structures underneath, the sheet of fabric of the bag 500 wrapped around the support structures is shaped to form a slanted front wall 507, a straight front wall 509, a bottom wall 511, and a back wall 513 of the bag 500. A flap 515 is also present shown hanging down from near a top-back corner of the support structures. The flap 515 may be folded over the top of the bag such that the distal edge of the flap 515 reaches the slanted front wall 507 to form a "top wall" that covers and closes the top opening of the bag 500 (not shown). A first support structure 501 is shown as a partition without spaces or openings on one end of the bag, such that a filling material loaded into the bag 500 through a top opening does not spill out the side end of the bag. In addition, a second support structure 503 and a third support structure 505 are shown in the truncated segment of the bag 500 with each having crossing members that provide strength to the bag but allow the filling material to flow through.

The second support structure 503 is shown having a frame including a back side 503*a*, a top side 503*b*, a slanted front side (not visible), a straight front side (not visible) and a bottom side (not visible). The second support structure 503 further has a first set of crossing members 503*c* and a second set of crossing members 503*d* that are shown to intersect at approximately right angles. Likewise, the third support structure 505 is shown having a frame including a back side 505*a*, a top side 505*b*, a slanted front side (not visible), a straight front side (not visible) and a bottom side (not visible). The third support structure 505 further has a first set of crossing members 505*c* and a second set of crossing members 505*d* that are shown to intersect at approximately right angles. To attach the sheet of fabric to the support structures, a variety of attachment types and methods described above may be used, which may include fasteners 520, such as rivets, etc., as shown. These attachments may be aligned in a row (or nearly a row) to correspond to the placement of a respective support structure. A reinforced strip may also be provided where these attachments pierce the wall of the bag to avoid or minimize tearing of the bag 500. In addition, pull tabs 517 may also be provided at the top near the junction of the top side and slanted front side of the support structures to assist with maneuvering the bag.

The present invention further proposes methods for making and using any of the support structure(s) as well as any bag comprising one or more support structure(s) of the present invention as described herein. According to one set of embodiments, a method is provided for making, assembling, etc., a bag comprising one or more support structures. In a first step, a support structure may be inserted or placed into a bag, which may be followed by additional step(s) of inserting or placing additional support structure(s) into the bag. According to some embodiments, the bag may already be formed or configured to have front, back, bottom, and side walls. Thus, the support structure(s) may be inserted into the preformed bag to give it more rigidity and keep it standing up. The support structures may be placed at predetermined or desired positions within the bag relatively in an approximately parallel arrangement with a predetermined or desired spacing. According to some embodiments, one or more of the support structures may be placed next to one or more of the side walls of the bag. According to other embodiments, two side walls of the bag may be closely spaced apart, such as by a distance approximating the widest dimension of a support structure, to provide a sleeve or slot into which a support structure may be inserted and held in place.

According to other embodiments, the bag may not be preconfigured or preformed into a shape but may instead be formed or shaped around support structure(s). According to these embodiments, a flexible sheet material, which may be one continuous sheet of material, may be wrapped around an outer periphery of the support structure(s) tightly enough to form the walls of the bag conforming to the outer shape of the support structure(s). As a result, the bag may have a straight front wall, a slanted front wall, a bottom wall and a back wall corresponding to the respective sides of the support structure (s). A top opening may also be formed for receiving a filling material with or without a flap for closing the top opening. The size and shape of the support structures used, inserted, placed, etc., in a same bag may be approximately the same to create a uniform cross-sectional shape along the length of the bag.

Regardless of whether the bag is formed around the support structure(s) or the support structure(s) are inserted into a preformed bag, the wall(s) of the bag may be attached, fastened, etc., to the support structure(s) in any suitable manner as described above. Finally, the bag may be filled with one or more filling material(s).

According to some embodiments, a bag of the present invention formed by any method may be collapsed in its lengthwise direction such that the support structures are brought closer together. This collapsing of the bag may facilitate storage and transporting of the bag to a desired location. When setting up the bag for use, the bag may be extended from a collapsed state in its lengthwise direction and the support structures separated from each other at a desired location until the front, bottom and back walls of the bag are fully extended (e.g., substantially planar). Finally, the bag may be filled with one or more filling material(s).

While the present invention may have been disclosed with reference to certain embodiments, it will be apparent that modifications and variations are possible without departing from the spirit and scope of the invention as defined herein. Furthermore, it should be appreciated that any and all examples in the present disclosure, while illustrating embodiments of the invention, are provided as non-limiting examples and are, therefore, not to be taken as limiting the various aspects so illustrated. The present invention is intended to have its full scope consistent with the following claims, and equivalents thereof. Accordingly, the drawings and description are to be regarded as illustrative and not as restrictive.

What is claimed is:

1. A bag comprising:

at least one flexible sheet of material; and at least one support structure;

wherein the at least one support structure comprises a frame having a top side, a bottom side, a back side substantially orthogonal to the bottom side and a slanted front side; a first set of crossing members; and a second set of crossing members, wherein the first set of crossing members spans from the slanted front side of the frame to the back side of the frame, and the second set of crossing members spans from the top side of the frame to the bottom side of the frame;

wherein at least one crossing member of the first set of crossing members intersects at least one crossing member of the second set of crossing members, and wherein the at least one flexible sheet of material is coupled with the frame of the at least one support structure by at least one fastener.

2. The bag of claim 1, wherein the bag comprises at least two support structures.

3. The bag of claim 2, wherein the at least two support structures are arranged approximately in parallel.

4. The bag of claim 1, wherein the bag has a bottom wall, a back wall and a slanted front wall corresponding to the respective bottom side, back side and slanted front side of the frame of the at least one support structure.

5. The bag of claim 4, wherein the at least one support structure further comprises a straight front side and the bag further has a straight front wall corresponding to the respective straight front side of the frame of the at least one support structure.

6. The bag of claim 4, wherein the bag further has a plurality of cells.

7. The bag of claim 6, wherein the bag further has at least one side wall, the at least one side wall separating two adjacent cells of the bag.

8. The bag of claim 1, wherein the at least one flexible sheet of material consists of a single flexible sheet of material.

9. The bag of claim 1, wherein the at least one fastener is configured to releasably engage the at least one flexible sheet of material.

10. The bag of claim 1, wherein the intersection of the at least one crossing member of the first set of crossing members and the at least one crossing member of the second set of crossing members forms a spacing sufficient to allow fill material to flow through the frame of the at least one support structure.

11. The bag of claim 10, wherein the spacing of the crossing members allows crushed rock of average particulate size of one inch or more to flow through the frame of the at least one support structure.

12. The bag of claim 10, comprising:

a vertical spacing between the members of the first set of crossing members;

a horizontal spacing between the members of the second set of crossing members; and wherein the respective vertical spacing and the respective horizontal spacing of the crossing members within a plane of the support structure is one inch or more.

13. The bag of claim 1, comprising:

at least one restricting support structure, wherein the restricting support structure prevents fill material from flowing through the restricting support structure.

14. The bag of claim 13, wherein the at least one restricting support structure is releasably engaged with the bag at an end of the bag, and the at least one support structure is releasably engaged with the bag.

15. The bag of claim 13, comprising a first restricting support structure releasably engaged with the bag at a first end of the bag;

a second restricting support structure releasably engaged with the bag at a second end of the bag; and wherein the at least one support structure is releasably engaged with the bag between the first and second restricting support structures.

* * * * *